US006655460B2

(12) United States Patent
Bailey et al.

(10) Patent No.: US 6,655,460 B2
(45) Date of Patent: Dec. 2, 2003

(54) METHODS AND APPARATUS TO CONTROL DOWNHOLE TOOLS

(75) Inventors: Thomas F. Bailey, Houston, TX (US); Michael Nero, Houston, TX (US); Timothy L. Wilson, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/976,845

(22) Filed: Oct. 12, 2001

(65) Prior Publication Data

US 2003/0070842 A1 Apr. 17, 2003

(51) Int. Cl.[7] ..... E21B 31/107; E21B 4/14

(52) U.S. Cl. ..... 166/301; 166/178; 166/65.1; 175/297; 175/73

(58) Field of Search ..... 166/301, 178, 166/65.1, 66, 66.4–66.7; 175/297, 55, 73

(56) References Cited

U.S. PATENT DOCUMENTS

| | | | | |
|---|---|---|---|---|
| 2,153,883 A | | 4/1939 | Foster et al. | 255/27 |
| 3,191,677 A | | 6/1965 | Kinley | 166/14 |
| 3,424,244 A | | 1/1969 | Kinley | 155/114 |
| 3,528,498 A | | 9/1970 | Carothers | 166/55 |
| 3,616,868 A | | 11/1971 | Bassinger | 175/92 |
| 4,243,112 A | * | 1/1981 | Sartor | 175/55 |
| 4,416,494 A | * | 11/1983 | Watkins et al. | 439/198 |
| 4,508,174 A | * | 4/1985 | Skinner et al. | 166/373 |
| 4,512,424 A | | 4/1985 | Heemstra | 175/299 |
| 4,736,797 A | * | 4/1988 | Restarick et al. | 166/301 |
| 4,890,682 A | | 1/1990 | Worrall et al. | 175/61 |
| 5,033,557 A | * | 7/1991 | Askew | 175/297 |
| 5,086,853 A | | 2/1992 | Evans | 175/297 |
| 5,520,255 A | | 5/1996 | Barr et al. | 175/24 |
| 5,553,679 A | | 9/1996 | Thorp | 175/73 |
| 5,706,905 A | | 1/1998 | Barr | 175/61 |
| 6,029,748 A | | 2/2000 | Forsyth et al. | 166/380 |
| 6,112,818 A | | 9/2000 | Campbell | 166/384 |
| 6,234,719 B1 | * | 5/2001 | Roynestad | 405/232 |
| 6,290,004 B1 | | 9/2001 | Evans | 175/296 |
| 6,296,066 B1 | * | 10/2001 | Terry et al. | 175/92 |
| 6,481,495 B1 | * | 11/2002 | Evans | 166/65.1 |

FOREIGN PATENT DOCUMENTS

| | | | |
|---|---|---|---|
| WO | WO 97/20130 | 6/1997 | E21B/43/10 |

OTHER PUBLICATIONS

Partial International Search Report dated Oct. 23, 2002, for application No. PCT/GB02/02797.
British Search Report dated Oct. 24, 2001, for application No. GB0114872.5.
PCT International Search Report, International Application No. PCT/GB 02/04646, dated Mar. 12, 2003.

* cited by examiner

*Primary Examiner*—David Bagnell
*Assistant Examiner*—T. Shane Bomar
(74) *Attorney, Agent, or Firm*—Moser, Patterson & Sheridan, L.L.P.

(57) ABSTRACT

The present invention generally provides a downhole tool with an improved means of transmitting data to and from the tool through the use of wired pipe capable of transmitting a signal and/or power between the surface of the well and any components in a drill string. In one aspect, a downhole tool includes a body, and a mandrel disposed in the body and movable in relation to the body. A conducive wire runs the length of the body and permits signals and/or power to be transmitted though the body as the tool changes its length.

13 Claims, 11 Drawing Sheets

METHODS AND APPARATUS TO CONTROL DOWNHOLE TOOLS

BACKGROUND OF THE INVENTION

1. Field of the Invention

The present invention relates to downhole tools. More particularly, the invention relates to the control of downhole tools in a drill string from the surface of a well.

2. Description of the Related Art

Communication to and from downhole tools and components during drilling permits real time monitoring and controlling of variables associated with the tools. In some instances pulses are sent and received at the surface of a well and travel between the surface and downhole components. In other instances, the pulses are created by a component in a drill string, like measuring-while-drilling ("MWD") equipment. MWD systems are typically housed in a drill collar at the lower end of the drill string. In addition to being used to detect formation data, such as resistivity, porosity, and gamma radiation, all of which are useful to the driller in determining the type of formation that surrounds the borehole, MWD tools are also useful in transmitting and receiving signals from the other downhole tools. Present MWD systems typically employ sensors or transducers which continuously or intermittently gather information during drilling and transmit the information to surface detectors by some form of telemetry, most typically a mud pulse system. The mud pulse system creates acoustic signals in drilling mud that is circulated through the drill string during drilling operations. The information acquired by the MWD sensors is transmitted by suitably timing the formation of pressure pulses in the mud stream. The pressure pulses are received at the surface by pressure transducers which convert the acoustic signals to electrical pulses which are then decoded by a computer.

There are problems associated with the use of MWD tools, primarily related to their capacity for transmitting information. For example, MWD tools typically require drilling fluid flow rates of up to 250 gallons per minute to generate pulses adequate to transmit data to the surface of the well. Additionally, surface the amount of data transferable in time using a MWD is limited. For example, about 8 bits of information per second is typical of a mud pulse device. Also, mud pulse systems used by an MWD device are ineffective in compressible fluids, like those used in underbalanced drilling.

Wireline control of downhole components provides adequate dada transmission of 1,200 bits per second but includes a separate conductor that can obstruct the wellbore and can be damaged by the insertion and removal of tools.

Other forms of communicating information in a drilling environment include wired assemblies wherein a conductor capable of transmitting information runs the length of the drill string and connects components in a drill string to the surface of the well and to each other. The advantage of these "wired pipe" arrangements is a higher capacity for passing information in a shorter time than what is available with a mud pulse system. For example, early prototype wired arrangements have carried 28,000 bits of information per second.

One problem arising with the use of wired pipe is transferring signals between sequential joints of drill string. This problem has been addressed with couplings having an inductive means to transmit data to an adjacent component.

In one example, an electrical coil is positioned near each end of each component. When two components are brought together, the coil in one end of the first is brought into close proximity with the coil in one end of the second. Thereafter, a carrier signal in the form of an alternating current in either segment produces a changing electromagnetic field, thereby transmitting the signal to the second segment.

More recently, sealing arrangements between tubulars provide a metal to metal conductive contact between the joints. In one such system, for example, electrically conductive coils are positioned within ferrite troughs in each end of the drill pipes. The coils are connected by a sheathed coaxial cable. When a varying current is applied to one coil, a varying magnetic field is produced and captured in the ferrite trough and includes a similar field in an adjacent trough of a connected pipe. The coupling field thus produced has sufficient energy to deliver an electrical signal along the coaxial cable to the next coil, across the next joint, and so on along multiple lengths of drill pipe. Amplifying electronics are provided in subs that are positioned periodically along the string in order to restore and boost the signal and send it to the surface or to subsurface sensors and other equipment as required. Using this type of wired pipe, components can be powered from the surface of the well via the pipe.

Despite the variety of means for transmitting data up and down a string of components, there are some components that are especially challenging for use with wired pipe. These tools include those having relative motion between internal parts, especially axial and rotational motion resulting in a change in the overall length of the tool or a relative change in the position of the parts with respect to one another. For example, the relative motion between an inner mandrel and an outer housings of jars, slingers, and bumper subs can create a problem in signal transmission, especially when a conductor runs the length of the tool. This problem can apply to any type of tool that has inner and outer bodies that move relative to one another in an axial direction.

Drilling jars have long been known in the field of well drilling equipment. A drilling jar is a tool employed when either drilling or production equipment has become stuck to such a degree that it cannot be readily dislodged from the wellbore. The drilling jar is normally placed in the pipe string in the region of the stuck object and allows an operator at the surface to deliver a series of impact blows to the drill string by manipulation of the drill string. Hopefully, these impact blows to the drill string dislodging the stuck object and permit continued operation.

Drilling jars contain a sliding joint which allows relative axial movement between an inner mandrel and an outer housing without allowing rotational movement. The mandrel typically has a hammer formed thereon, while the housing includes a shoulder positioned adjacent to the mandrel hammer. By sliding the hammer and shoulder together at high velocity, a very substantial impact is transmitted to the stuck drill string, which is often sufficient to jar the drill string free.

Often, the drilling jar is employed as a part of a bottom hole assembly during the normal course of drilling. That is, the drilling jar is not added to the drill string once the tool has become stuck, but is used as a part of the string throughout the normal course of drilling the well. In the event that the tool becomes stuck in the wellbore, the drilling jar is present and ready for use to dislodge the tool. A typical drilling jar is described in U.S. Pat. No. 5,086,853 incorporated herein by reference in its entirety.

An example of a mechanically tripped hydraulic jar is shown in FIG. 1. The jar 100 includes a housing 105 and a central mandrel 110 having an internal bore. The mandrel moves axially in relation to the housing and the mandrel is threadedly attached to the drill string above (not shown) at a threaded joint 115. At a predetermined time measured by the flow of fluid through an orifice in the tool 100, potential force applied to the mandrel from the surface is released and a hammer 120 formed on the mandrel 110 strikes a shoulder 125 creating a jarring effect on the housing and the drill string therebelow that is connected to the housing at a threaded connection 130.

Methods to run a wire through a jar or tool of this type have not been addressed historically because the technology to send and receive high-speed data down a wellbore did not exist. Similarly, the option of using data and power in a drill string to change operational aspects of a jar have not been considered.

With recent advances in technology like wired pipe, there is a need to wire a jar in a drill string to permit data to continue down the wellbore. There is an additional need for a jar that can be remotely operated using data transmitted by wired pipe, whereby performance of the jar can be improved. There is a further need therefore, for a simple and efficient way to transmit data from an upper to a lower end of a wellbore component like a jar. There is a further need to transmit data through a jar where no wire actually passes through the jar. There is yet a further need for methods and apparatus to control the operational aspects of a jar in order to compensate and take advantage of dynamic conditions of a wellbore.

Jars are only one type of tool found in a drill string. There are other tools that could benefit from real time adjustment and control but that have not been automated due to the lack of effective and usable technology for transmitting signals and power downhole. Still other tools are currently controlled from the surface but that control can be much improved with the use of the forgoing technology that does not rely upon pulse generated signals. Additionally, most of the drill string tools today that are automated must have their own source of power, like a battery. With wired pipe, the power for these components can also be provided from the surface of the well.

SUMMARY OF THE INVENTION

The present invention generally provides a downhole tool with an improved means of transmitting data to and from the tool through the use of wired pipe capable of transmitting a signal and/or power between the surface of the well and any components in a tubular string. In one aspect, a downhole tool includes a body, and a mandrel disposed in the body and movable in relation to the body. A conducive wire runs the length of the body and permits signals and/or power to be transmitted though the body as the tool changes its length.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides apparatus and methods for controlling and powering downhole tools through the use of wired pipe.

Using high-speed data communication through a drill string and running a wire through a drilling jar, a jar can be controlled from the surface of a well after data from the jar is received and additional data is transmitted back to the jar to affect its performance. Alternately, the jar can have a programmed computer on board or in a nearby member that can manipulate physical aspects of the jar based upon operational data gathered at the jar.

Figure 1:
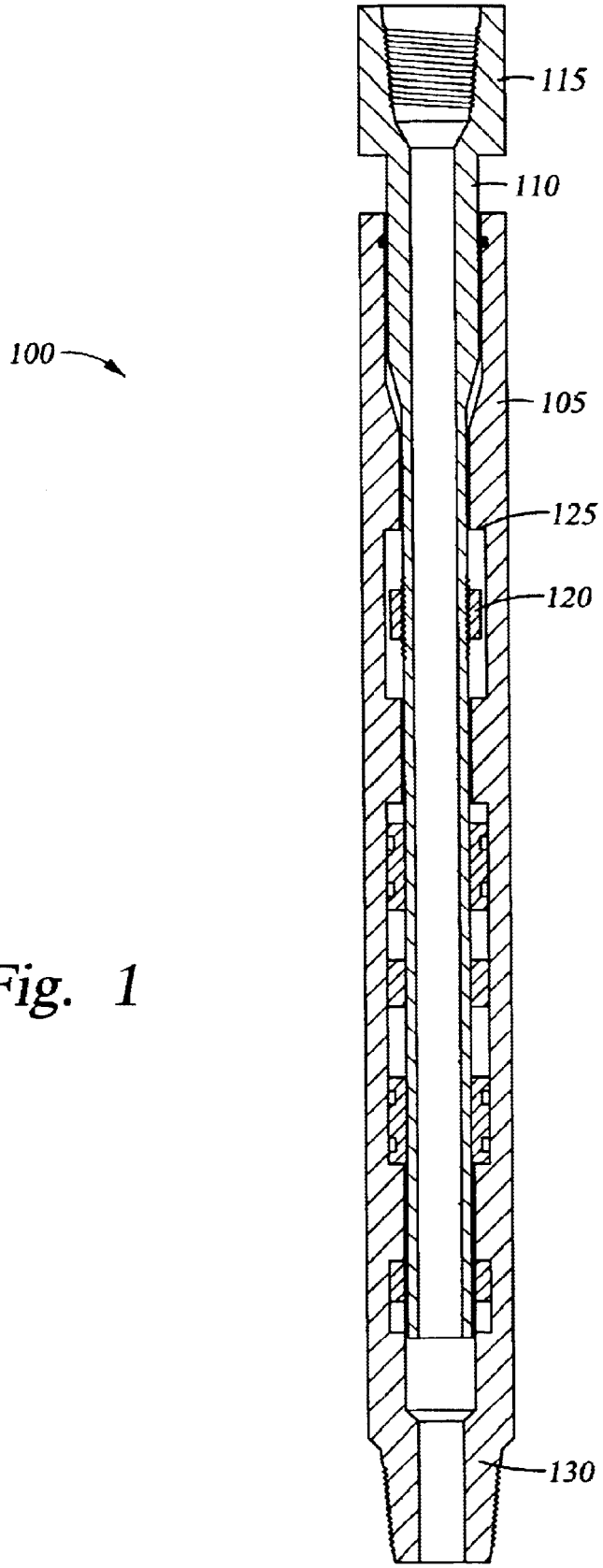
FIG. 1 is a section view of a jar for use in a drilling string.
Figure 2A:
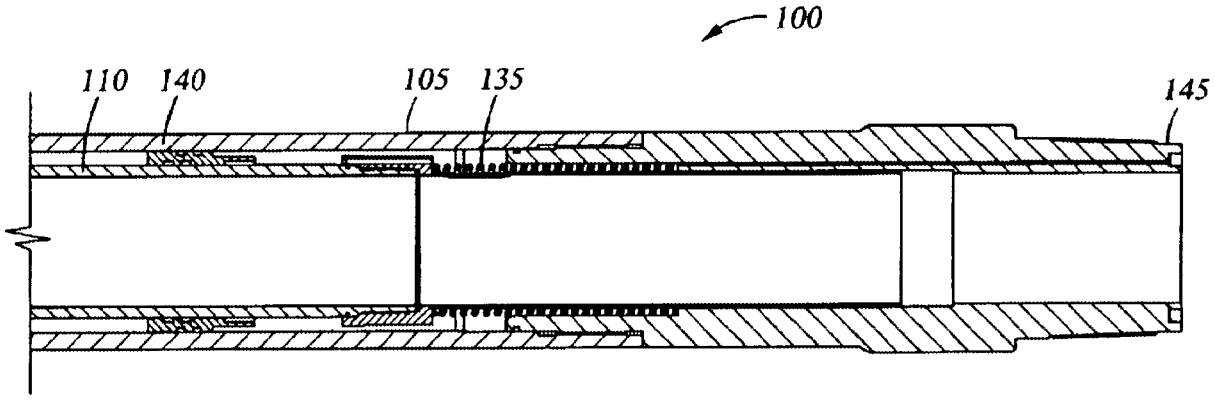
FIGS. 2A and 2B illustrate the jar in a retracted and extended position with a data wire disposed in an interior thereof.
Figure 2B:
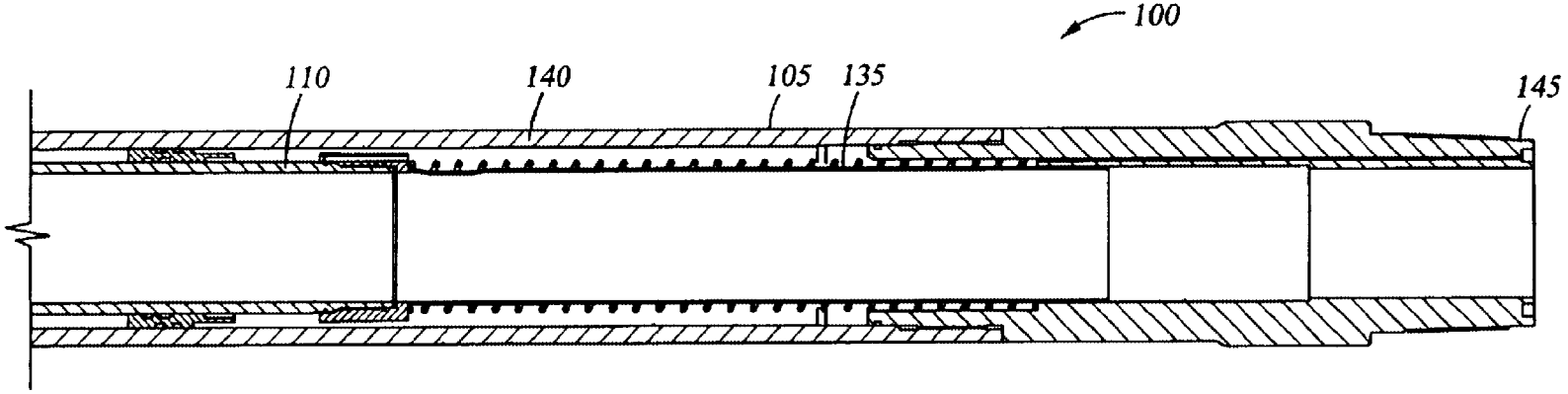

FIG. 2A illustrates a jar 100 in a retracted position and FIG. 2B shows the jar in an extended position. The jar 100 includes a coiled spring 135 having a data wire disposed in an interior thereof, running from a first 140 to a second end 145 of the tool 100. The coiled spring and data wire is of a length to compensate for relative axial motion as the tool 100 is operated in a wellbore. In the embodiment of FIGS. 2A and 2B, the coil spring and data wire 135 are disposed around an outer diameter of the mandrel 110 to minimize interference with the bore of the tool 100. In order to install the jar in a drill string, each end of the jar includes an inductive coupling ensuring that a signal reaching the jar from above will be carried through the tool to the drill string and any component therebelow. The induction couplings, because of their design, permit rotation during installation of the tool.

Figure 3A:
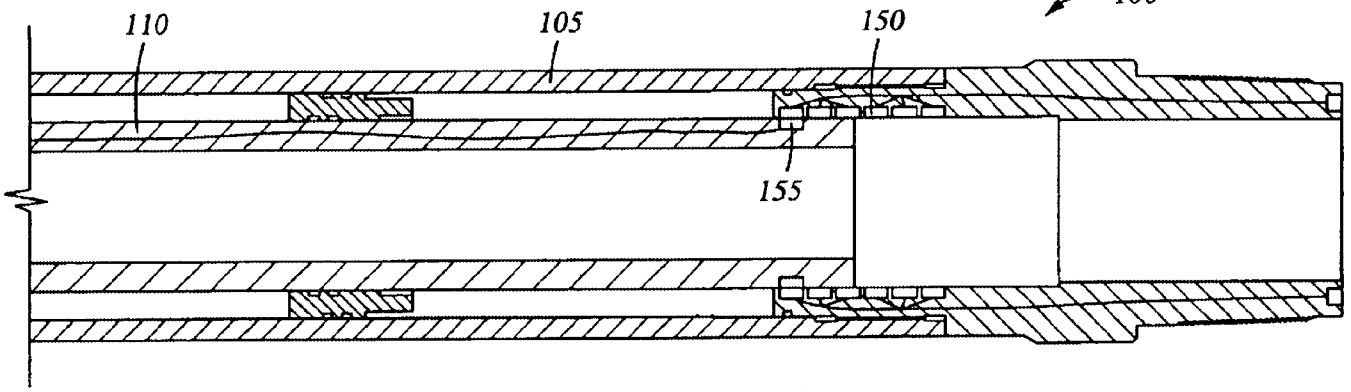
FIGS. 3A and 3B are section views of a jar having an inductive connection means between the jar housing and a central mandrel.

In another embodiment, a series of coils at the end of one of the jar components communicates with a coil in another jar component as the two move axially in relation to each other. FIG. 3A show a jar 100 with a housing 105 having a number of radial coils 150 disposed on an inside surface thereof. Each of the coils is powered with a conductor running to one end of the tool 100 where it is attached to drill string. A single coil 155 is formed on an outer surface of a mandrel 110 and is wired to an opposing end of the tool. The coils 150, 155 are constructed and arranged to remain in close proximity to each other as the tool operates and as the mandrel moves axially in relation to the housing.

Figure 3B:
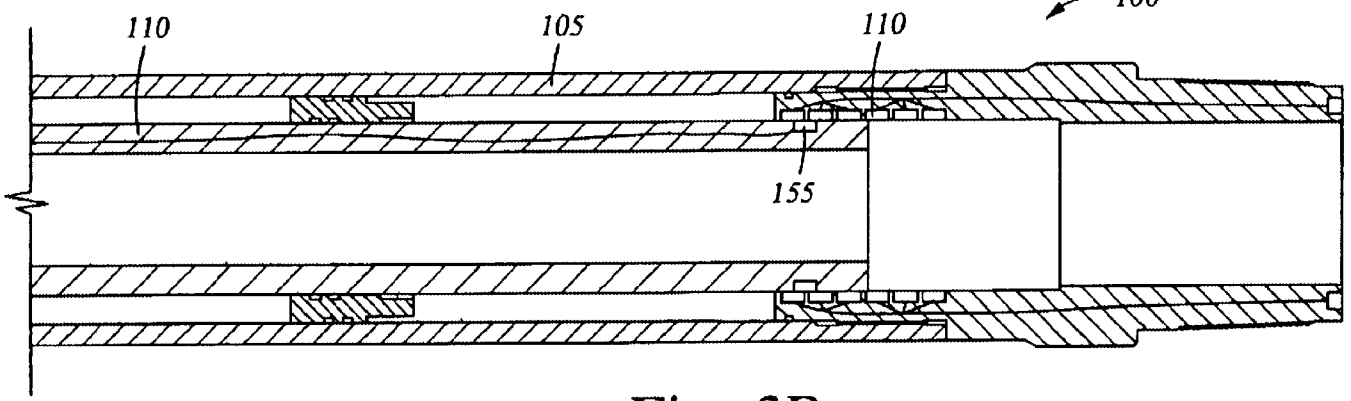

In FIG. 3A, a single coil 150 is opposite mandrel coil 155. In FIG. 3B, a view of the tool 100 after the mandrel has moved, the coil 155 is partly adjacent two of the coils 150, but close enough for a signal to pass between the housing and the mandrel. In an alternative embodiment, the multiple coils 150 cold be formed on the mandrel and the single coil could be placed on the housing.

Figure 4:
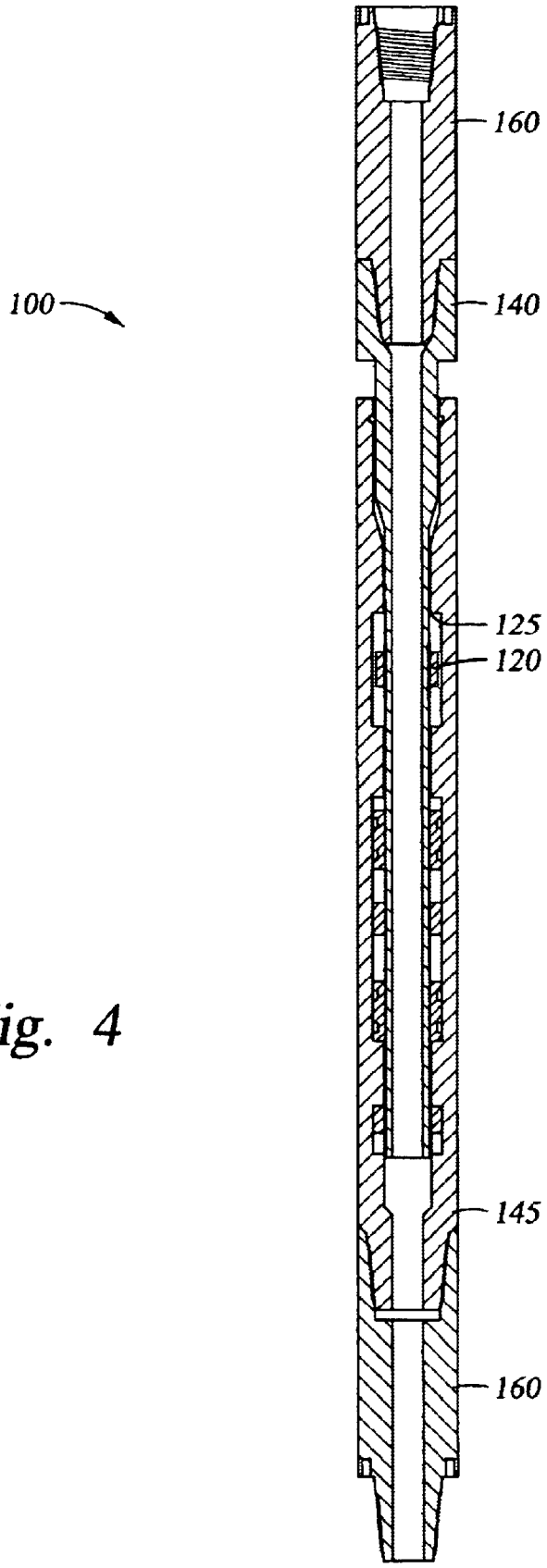
FIG. 4 is a section view of a jar having electromagnetic subs disposed at each end thereof.

In another embodiment, a signal is transmitted from a first to a second end of the tool through the use of short distance, electromagnetic (EM) technology. FIG. 4 is a section view of a jar 100 with E.M. subs 160 placed above and below the jar 100. The EM subs can be connected to wired drill pipe by induction couplings (not shown) or any other means. The subs can be battery powered and contain all means for wireless transmission, including a microprocessor. Using the E.M. subs 160, data can be transferred around the jar without the need for a wire running through the jar. By using this arrangement, a standard jar can be used without any modification and the relative axial motion between the mandrel and the housing is not a factor. This arrangement could be used for any type of downhole tool to avoid a wire member in a component relying upon relative axial or rotational motion. Also, because of the short transmission distance, the power requirements for the transmitter in the subs 160 is minimal.

Figure 5A:
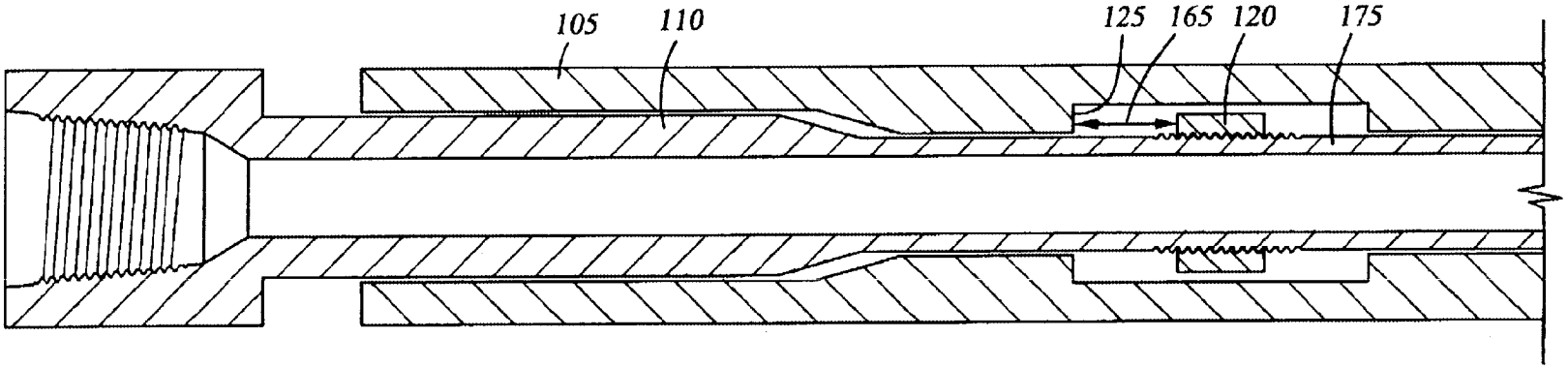
FIGS. 5A and 5B are section views showing a jar with a hammer that is adjustable along the length of a central mandrel.
Figure 5B:
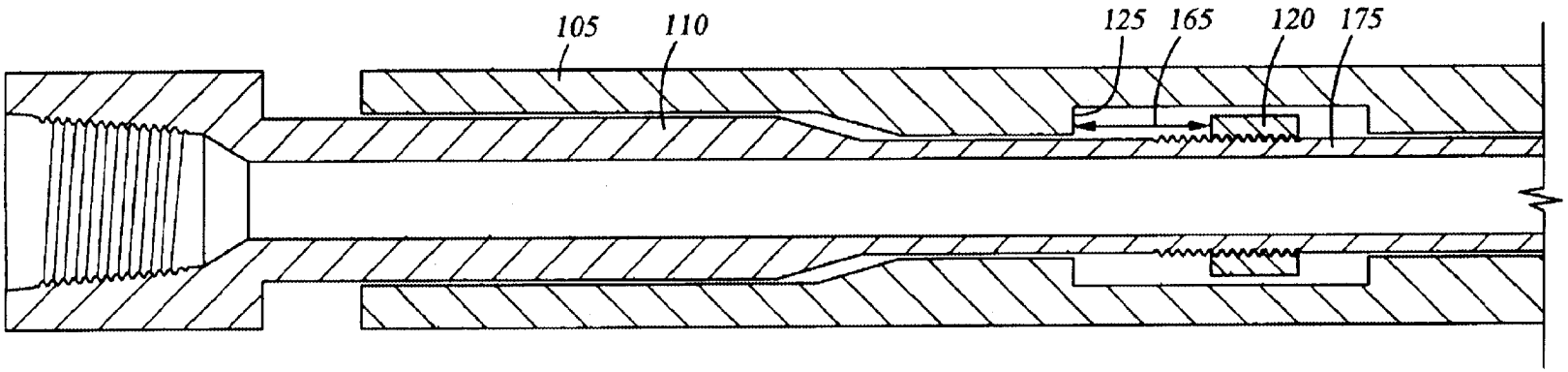

In other embodiments, various operational aspects of a jar in a drill string of wired pipe can be monitored and/or manipulated. For example, FIGS. 5A and 5B are section views of a jar 100 illustrating a means of adjusting the magnitude of jarring impact. A pressure sensor (not shown) in a high pressure chamber of the jar 100 can be used to determine the exact amount of overpull placed upon the jar from the surface of the well. An accelerometer (not shown) can be used to measure the actual impact of the hammer 120 against the shoulder 125 after each blow is delivered. This information can then be used by an operator along with a jar placement program to optimize the amount of overpull and adjust the free stroke length 165 of the jar to maximize the impact. The stroke length is adjustable by rotating the hammer 120 around a threaded portion 175 of the mandrel 110, thus moving the hammer closer or further from the shoulder 125. By changing the free stroke length 165 between the hammer 120 and the shoulder 125, the distance the hammer travels can be optimized to deliver the greatest impact force. For example, adjusting the stroke length would allow the impact to occur when the hammer has reached its maximum velocity. The free stroke length may need to be longer or shorter depending on the amount of pipe stretch, hole drag, etc. In conventional jars, the amount of free stroke can only be set at one distance and therefore the hammer can lose velocity or not reach its full velocity before impact. An actuator, like a battery operated motor might be used in the tool 100 to cause the movement of the hammer 120 along the threaded portion 175 of the mandrel 110.

Figure 6A:
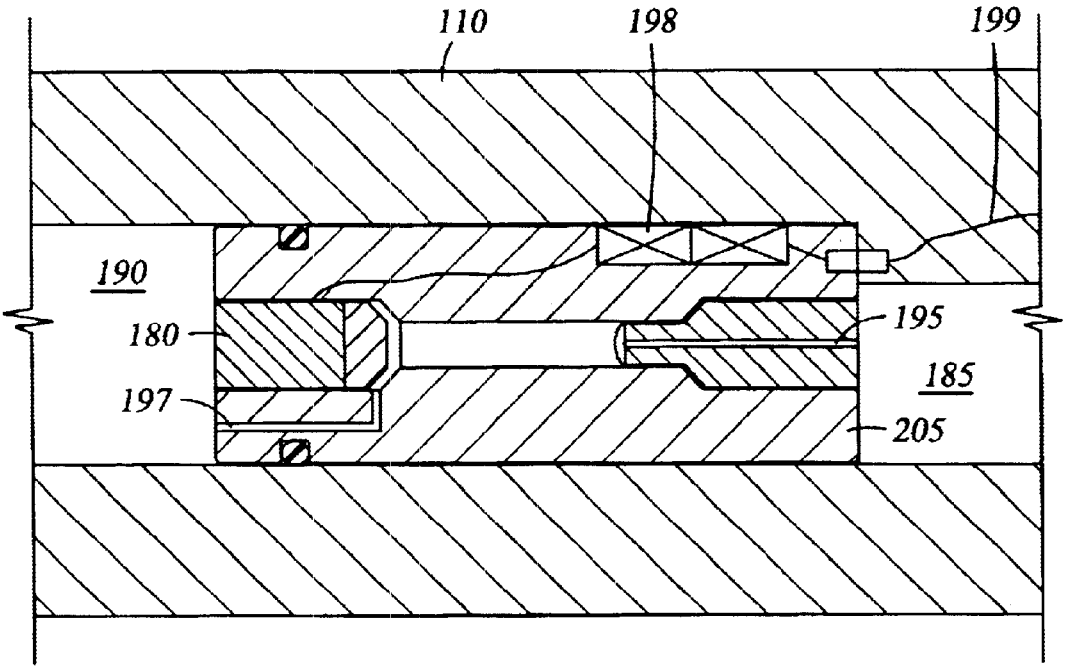
FIGS. 6A and 6B are section views of a jar having a mechanism to cause the jar to be non-functional.
Figure 6B:
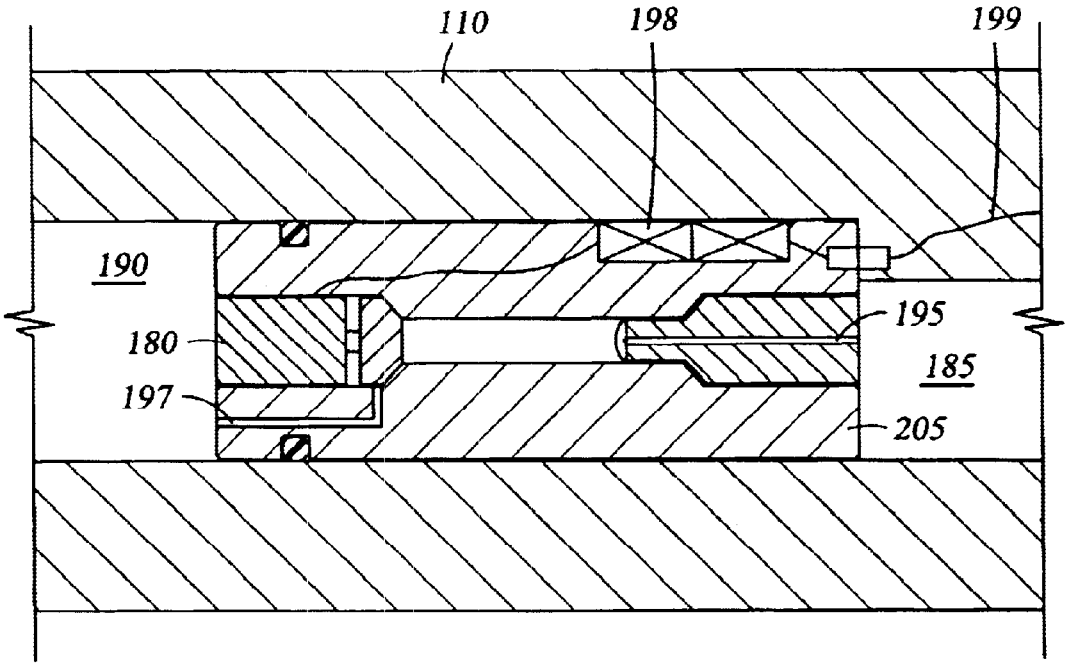

In another embodiment, the operation of a jar can be controlled in a manner that can render the tool inoperable during certain times of operation. FIGS. 6A and 6B are section views of a tool 100 showing a solenoid 180 located in the bore of the mandrel 110. The purpose of the solenoid is to stop metering flow in the jar until a signal is received to allow the jar to meter fluid as normal. In FIG. 6A the solenoid 180 is in an open position permitting fluid communication between a low pressure chamber 185 and a high pressure chamber 190, through a metering orifice 195 and a fluid path 197 blocks the flow of internal fluid between the chambers 185, 190 and does not allow the mandrel 110 to move to fire the jar 100. When in the position of FIG. 6B, the jar 100 can operate like a stiff drill string member when not needed. This makes running in much easier and safer by not having to contend with accidental jarring. This also overcomes problems associated with other jars that have a threshold overpull that must be overcome to jar. Using this arrangement, the jar works through a full range of overpulls without any minimum overpull requirements. Also, by making the solenoid 180 assume the "closed" position when not connected to a power line, the requirement for a safety clamp can be eliminated. This feature is especially useful in horizontal drilling applications where external forces can cause a jar to operate accidentally. As shown in the Figures, the solenoid is typically powered by a battery 198 which is controlled by a line 199.

Figure 7A:
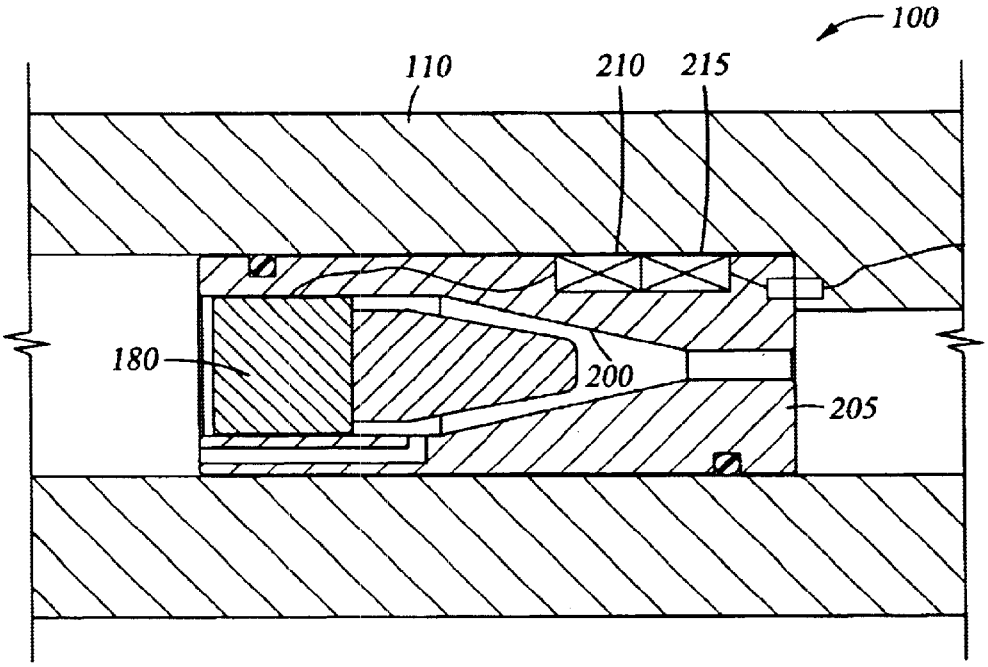
FIGS. 7A and 7B are section views of a portion of a jar having an adjustable orifice therein.
Figure 7B:
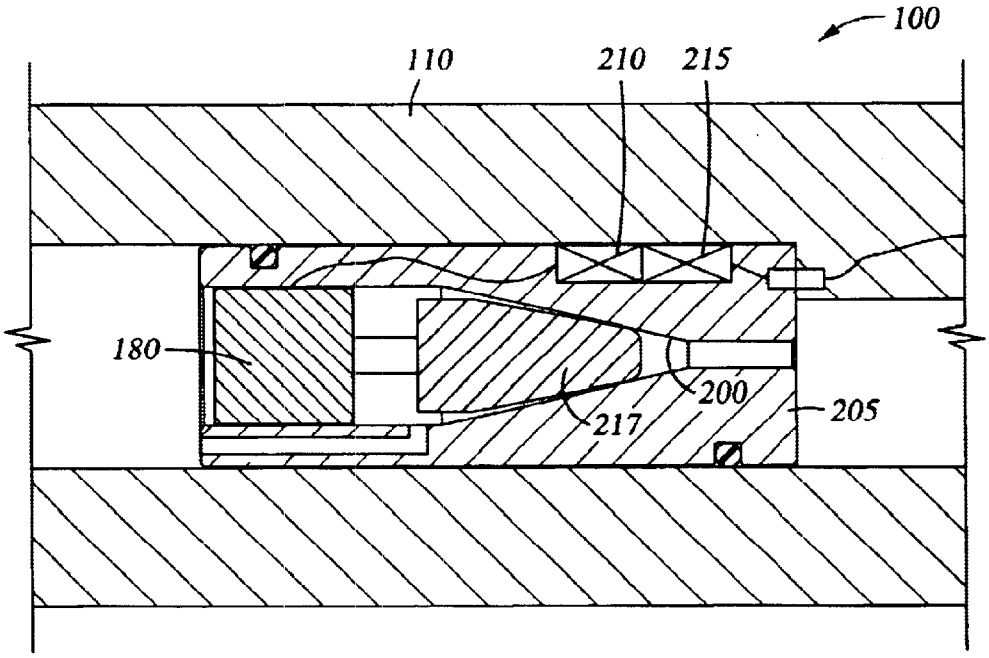

In another embodiment, the timing of operation of a jar can be adjusted by changing the size of an orifice in the jar through which fluid is metered. FIGS. 7A and 7B are section views of a jar 100 with an orifice 200 disposed therein. A solenoid 180 is placed in an internal piston 205 of the jar 100 and a battery 210 and microprocessor 215 are installed adjacent the solenoid 180. By moving the solenoid 180 between a first and second positions, the relative size of the orifice can be changed, resulting in a change in the time needed for the jar to operate. For example, in FIG. 7A with the solenoid 180 holding a plug 217 in a retracted position, the orifice is a first size and in FIG. 7B with the solenoid holding the plug 217 in an extended position, the orifice is a second, smaller size. Alternatively, the orifice can be completely closed. With the ability to change the amount of time between the start of overpull and the actual firing of the jar, the number and magnitude of the blows can be affected. For example, by allowing more time before firing, the operator could be sure that the maximum overpull was being applied at the jar and that the overpull is not being diminished by hole drag or other hole problems. By changing the timing to a faster firing time, the operator can get more hits in a given amount of time.

Figure 8A:
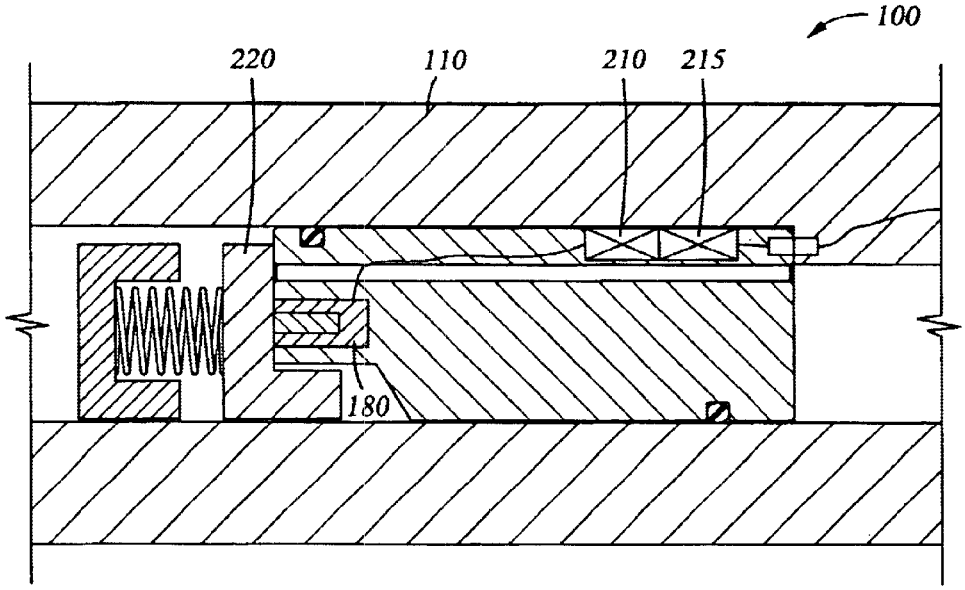
FIGS. 8A and 8B are section views of a portion of a jar having a mechanism therein for permitting the jar to operate as a bumper sub.
Figure 8B:
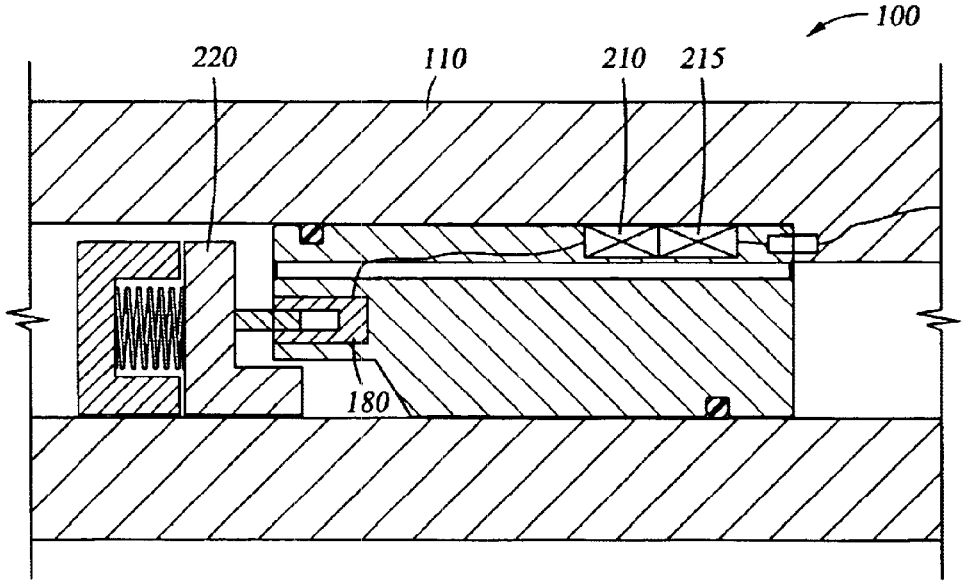

In still another embodiment, a jar 100 can be converted to operate like a bumper sub during operation. A bumper sub is a shock absorber-like device in a drill string that compensates for jarring that takes place as a drill bit moves along and forms a borehole in the earth. In the embodiment of FIGS. 8A and 8B, a section view of a jar 100, a solenoid 180 is actuated to open a relatively large spring-loaded valve 220 (FIG. 8B) that allows internal fluid to freely pass through the tool 100. Since no internal pressure can build up, the tool opens and closes freely. This feature provides the usefulness of a bumper sub when needed during drilling.

Figure 9:
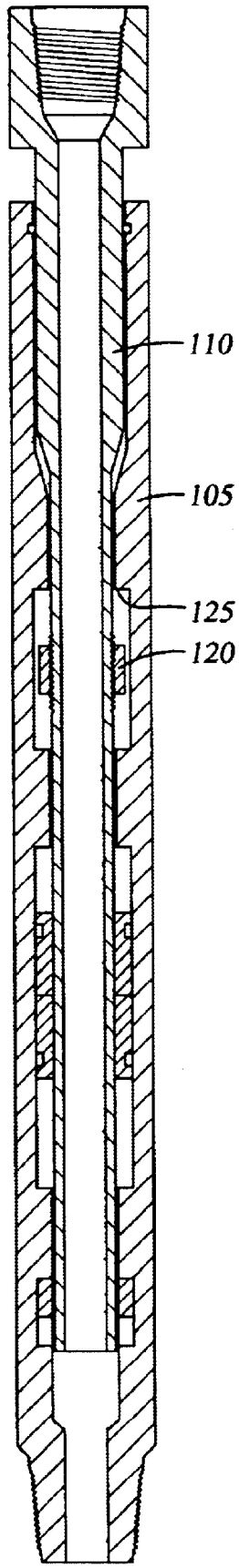
FIG. 9 is a section view of a jar that operates electronically without the use of metered fluid through an orifice.

FIG. 9 is a section view of an electronically actuated jar 100. Because data can be quickly transmitted to the jar using the wired pipe means discussed herein, a jar can be provided and equipped with an electronically controlled release mechanism. The release mechanism could be mechanical or electromagnetic. This mechanism would hold the jar in the neutral position until a signal to fire is received. The electronic actuation means eliminates the use of fluid metering to time the firing of the jar. By using an electronically actuated jar, many of the problems associated with hydraulic jars could be eliminated. This would eliminate bleed-off from the metering of hydraulic fluid and would allow the jar to fire only when the operator is ready for it to actuate. Also, because the jar would be mechanically locked at all times, the need for safety clamps and running procedures would be eliminated.

Figure 10:
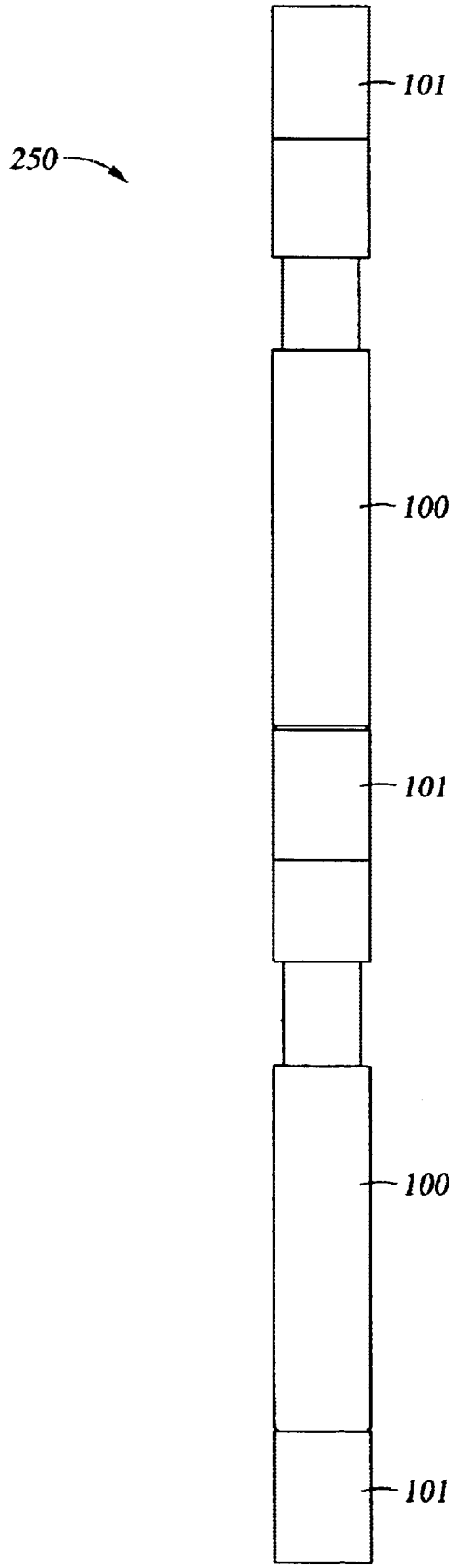
FIG. 10 is a section view showing a number of jars disposed in a drill string and operable in a sequential manner.

In another embodiment, jars 100 arranged in a series on a drill string 250 can be selectively fired to affect a stress wave in the wellbore. FIG. 10 shows jars 100 connected in a drill string 250 with collars or drill pipe 101 therebetween. By using an electronically actuated jar, a series of jars could be set off at slightly different times to maximize the stress wave propagation and impulse. Stress wave theory could be used to calculate the precise actuation times, weight and length of collars, and drill string arrangement to generate the largest impulse to free the stuck string. Data measuring the effectiveness of each actuation could be sent to the surface for processing and adjustment before the next actuation of the jars. Using this arrangement with wired pipe, it is possible to maximize the impulse each time and therefore give a greater chance of freeing the drill string each time. This would result in fewer jarring actions and less damage to drill string components.

While the invention has been described with respect to jars run on drill pipe, the invention with its means for transmitting power and signals to and from a downhole component is equally useful with tubing strings or any string of tubulars in a wellbore. For example, jars are useful in fishing apparatus where tubing is run into a well to retrieve a stuck component or tubular. In these instances, the tubing can be wired and connections between subsequent pieces of tubular can include contact means having threads, a portion of which are conductive. In this manner, the mating threads of each tubular have a conductive portion and an electrical connection is made between each wired tubular.

Figure 11A:
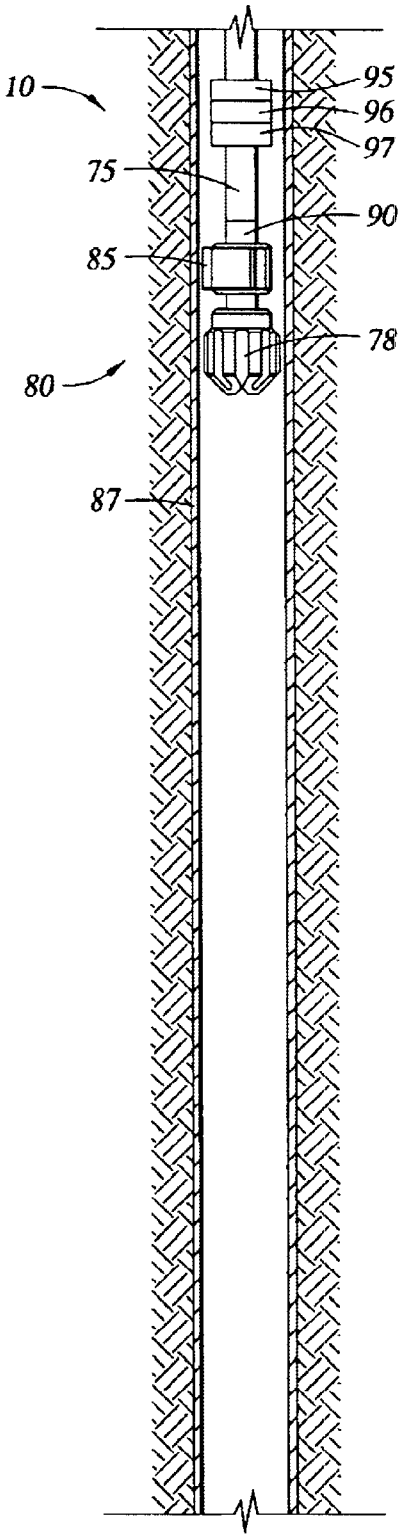
FIGS. 11A and 11B are section views of a wellbore showing a rotatable steering apparatus.
Figure 11B:
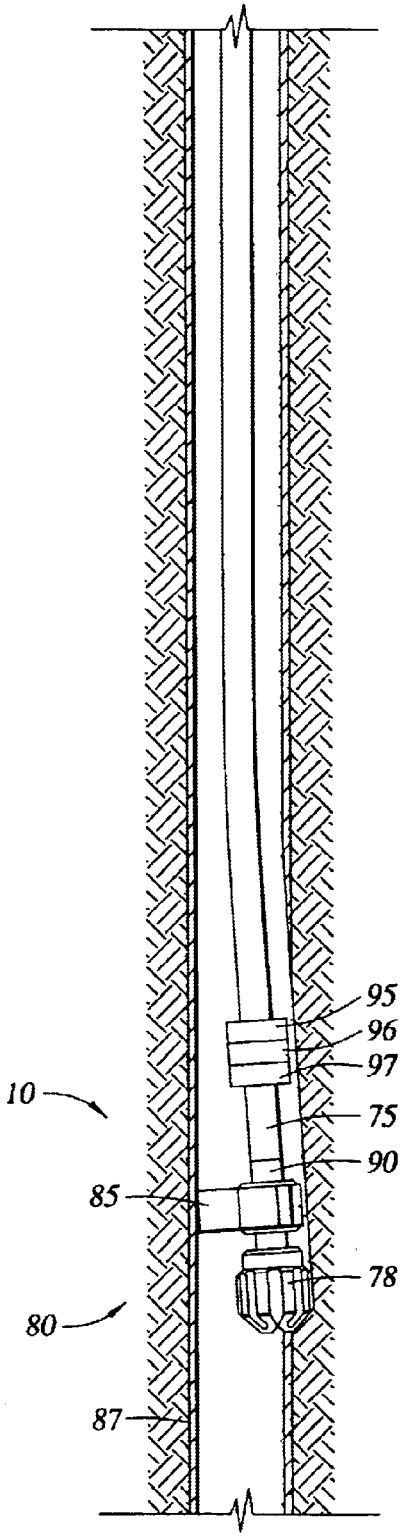

FIGS. 11A and 11B are section views of a wellbore showing a rotatable steering apparatus 10 disposed on a drill string 75. The apparatus includes a drill bit 78 or a component adjacent the drill bit in the drilling string that includes non-rotating, radially outwardly extending pads 85 which can be actuated to extend out against the borehole or in some cases, the casing 87 of a well and urge the rotating drill bit in an opposing direction. Using rotatable steering, wellbores can be formed and deviated in a particular direction to more fully and efficiently access formations in the earth. In FIG. 11A, the drill bit 78 is coaxially disposed in the wellbore. In FIG. 11B, the drill bit 78 has been urged out of a coaxial relationship with the wellbore by the pad 85. Typically, a rotatable steering apparatus includes at least three extendable pads and technology exists today to control the pads by means of pulse signals which are transmitted typically from a MWD device 90 disposed in the drill string thereabove. By sending pulse signals similar to those described herein, the MWD can determine which of the various pads 85 of the rotatable steering apparatus 10 are extended and thereby determine the direction of the drill bit. As stated herein, only a limited amount of information can be transmitted using pulse signals and the rotatable steering device must necessarily has its own source of power to actuate the pads. Typically, an on-board battery supplies the power. Rotary steerable drilling is described in U.S. Pat. Nos. 5,553,679, 5,706,905 and 5,520,255 and those patents are incorporated herein by reference in their entirety.

Using emerging technology whereby signals and/or power is provided in the drill string, the rotatable drilling apparatus can be controlled much more closely and the need for an on-board battery pack can be eliminated altogether. Using signals travelling back and forth between the surface of the well and the rotary drilling unit 10, the unit can be operated to maximize its flexibility. Additionally, because an ample amount of information can be easily transmitted back and forth in the wired pipe, various sensors can be disposed on the rotatable steering unit to measure the position and direction of the unit in the earth. For example, conditions such as temperature, pressure in the wellbore and formation characteristics around the drill bit can be measured. Additionally, the content and chemical characteristics of production fluid and/or drilling fluid used in the drilling operation can be measured.

In other instances a drill bit itself can be utilized more effectively with the use of wired pipe. For example, sensors can be placed on drill bits to monitor variables at the drilling location like vibration, temperature and pressure. By measuring the vibration and the amplitude associated with it, the information cold be transmitted to the surface and the drilling conditions adjusted or changed to reduce the risk of damage to the bit and other components due to resonate frequencies. In other examples, specialized drill bits with radially extending members for use in under-reaming could be controlled much more efficiently through the use of information transmitted through wired pipe.

Yet another drilling component that can benefit from real time signaling and power, is a thruster 95. A thruster is typically disposed above a drill bit in a drilling string and is particularly useful in developing axial force in a downward direction when it becomes difficult to successfully apply force from the surface of the well. For example, in highly deviated wells, the trajectory of the wellbore can result in a reduction of axial force placed on the drill bit. Installing a thruster near the drill bit can solve the problem. A thruster is a telescopic tool which includes a fluid actuated piston sleeve. The piston sleeve can be extended outwards and in doing so can supply needed axial force to an adjacent drill bit. When the force has been utilized by the drill bit, the drill string is moved downwards in the wellbore and the sleeve is retracted. Thereafter, the sleeve can be re-extended to provide an additional amount of axial force. Various other devices operated by hydraulics or mechanical can also be utilized to generate supplemental force and can make use of the invention.

Conventional thrusters are simply fluid powered and have no means for operating in an automated fashion. However, with the ability to transmit high speed data back and forth along a drill string, the thrusters can be automated and can include sensors to provide information to an operator about the exact location of the extendable sleeve within the body of the thruster, the amount of resistance created by the drill bit as it is urged into the earth and even fluid pressure generated in the body of the thruster as it is actuated. Additionally, using valving in the thruster mechanism, the thruster can be operated in the most efficient manner depending upon the characteristics of the wellbore being formed. For instance, if a lessor amount of axial force is needed, the valving of the thruster can be adjusted in an automated fashion from the surface of the well to provide only that amount of force required. Also, an electric on-board motor powered from the surface of the well could operate the thruster thus, eliminating the need for fluid power. With an electrically controlled thruster, the entire component could be switched to an off position and taken out of use when not needed.

Yet another component used to facilitate drilling and automatable with the use of wired pipe is a drilling hammer 96. Drilling hammers typically operate with a stroke of several feet and jar a pipe and drill bit into the earth. By automating the operation of the drilling hammer, its use could be tailored to particular wellbore and formation conditions.

Another component typically found in a drill string that can benefit from high-speed transfer of data is a stabilizer 97. A stabilizer is typically disposed in a drill string and, like a centralizer, includes at least three outwardly extending fin members which serve to center the drill string in the borehole and provide a bearing surface to the string. Stabilizers are especially important in directional drilling because they retain the drill string in a coaxial position with respect to the borehole and assist in directing a drill bit therebelow at a desired angle. Furthermore, the gage relationship between the borehole and stabilizing elements can be monitored and controlled. Much like the rotary drilling unit discussed herein, the fin members of the stabilizer could be automated to extend or retract individually in order to more exactly position the drill string in the wellbore. By using a combination of sensors and actuation components, the stabilizer could become an interactive part of a drilling system and be operated in an automated fashion.

Another component often found in a drilling string is a vibrator. The vibrators are disposed near the drill bit and operate to change the mode of vibration created by the bit to a vibration that is not resonant. By removing the resonance from the bit, damage to other downhole components can be avoided. By automating the vibrator its operation can be controlled and its own vibratory characteristics can be changed as needed based upon the vibration characteristics of the drill bit. By monitoring vibration of the bit from the surface of the well, the vibration of the vibrator can be adjusted to take full advantage to its ability to affect the mode of vibration in the wellbore.

The foregoing description has included various tools, typically components found on a drill string that can benefit from the high speed exchange of information between the surface of the well and a drill bit. The description is not exhaustive and it will be understood that the same means of providing control, signaling, and power could be utilized in most any tool, including MWD and LWD (logging while drilling) tools that can transmit their collected information much faster through wired pipe.

While the foregoing is directed to embodiments of the present invention, other and further embodiments of the invention may be devised without departing from the basic scope thereof, and the scope thereof is determined by the claims that follow.

What is claimed is:

1. A downhole tool comprising:

a housing;

a mandrel at least partially disposed in the housing and movable in relation to the housing;

an actuation mechanism, causing the mandrel to move from a first to a second position within the housing;

means for carrying a signal and/or power from a first to a second end of the tool whether the mandrel is in the first or second position within the housing, the signal and/or power running between a surface of a well and at least one other component on a tubular string below the tool; and a coupling at the first and second ends of the tool, the coupling providing a physical connection between the tool and the tubular string and a path for the signal and/or power between the tubular string and the tool, wherein the path for the signal and/or power includes an induction means between the tubular string and the tool.

2. A downhole tool comprising:

a housing;

a mandrel at least partially disposed in the housing and movable in relation to the housing;

an actuation mechanism, causing the mandrel to move from a first to a second position within the housing;

an electromagnetic sub including a signal boosting member disposed at first and second ends of the tool for carrying a signal and/or power from the first to the second end of the tool whether the mandrel is in the first or second position within the housing, the signal and/or power running between a surface of a well and at least one other component on a tubular string below the tool; and a coupling at the first and second ends of the tool, the coupling providing a physical connection between the tool and the tubular string and a path for the signal and/or power between the tubular string and the tool.

3. A downhole tool comprising:

a housing;

a mandrel at least partially disposed in the housing and movable in relation to the housing;

a hammer formed on a surface of the mandrel for contacting a shoulder formed on an inner wall of the housing, the hammer contacting the shoulder to produce a jarring force, wherein the hammer is adjustable along the mandrel to change a free striking range measured between the hammer and the shoulder;

an actuation mechanism, causing the mandrel to move from a first to a second position within the housing;

means for carrying a signal and/or power from a first to a second end of the tool whether the mandrel is in the first or second position within the housing, the signal and/or power running between a surface of a well and at least one other component on a tubular string below the tool; and a coupling at the first and second ends of the tool, the coupling providing a physical connection between the tool and the tubular string and a path for the signal and/or power between the tubular string and the tool.

4. The tool of claim 3, wherein the free striking range is adjustable in the well through the use of an actuator disposed proximate the hammer, the actuator causing the hammer to move along a threaded portion of the mandrel.

5. The tool of claim 4, wherein the actuator is electric and operates with a battery located adjacent the actuator.

6. A downhole tool comprising:

a housing;

a mandrel at least partially disposed in the housing and movable in relation to the housing;

a hammer formed on a surface of the mandrel for contacting a shoulder formed on an inner wall of the housing, the hammer contacting the shoulder to produce a jarring force;

an orifice through which fluid passes to cause the hammer to strike the shoulder at a predetermined time, wherein the orifice can be moved between an open and a closed position, the tool non-operable in the closed position;

an actuation mechanism, causing the mandrel to move from a first to a second position within the housing;

means for carrying a signal and/or power from a first to a second end of the tool whether the mandrel is in the first or second position within the housing, the signal and/or power running between a surface of a well and at least one other component on a tubular string below the tool; and a coupling at the first and second ends of the tool, the coupling providing a physical connection between the tool and the tubular string and a path for the signal and/or power between the tubular string and the tool.

7. The tool of claim 6, wherein the orifice includes multiple positions between the open and closed position permitting the orifice to assume a plurality of sizes.

8. The tool of claim 7, wherein the position of the orifice can be controlled from the surface of the well by a signal.

9. The tool of claim 8, wherein the orifice is moved with the use of a solenoid disposed adjacent the orifice and powered by a battery in the tool.

10. A downhole tool comprising:

a housing;

a mandrel at least partially disposed in the housing and movable in relation to the housing;

an actuation mechanism, causing the mandrel to move from a first to a second position within the housing, wherein the actuation mechanism is electronic and is operated with a signal from a surface of a well;

means for carrying a signal and/or power from a first to a second end of the tool whether the mandrel is in the first or second position within the housing, the signal and/or power running between the surface of the well and at least one other component on a tubular string below the tool; and a coupling at the first and second ends of the tool, the coupling providing a physical connection between the tool and the tubular string and a path for the signal and/or power between the tubular string and the tool.

11. A method of operating a jarring tool comprising:

lowering the jarring tool in a wellbore disposed on a string comprising a signal transmitting tubular;

sending a signal from a surface of the wellbore to adjust a free striking range of the jarring tool, the free striking range measured between a hammer and shoulder of the jarring tool; and sending a signal from the surface of the wellbore to the jarring tool to actuate the jarring tool, the signal traveling through the signal transmitting tubular.

12. A downhole tool comprising:

a housing;

a mandrel at least partially disposed within the housing, the mandrel and the housing being relatively movable with respect to each;

a plurality of radially formed contacts on an outer surface of the mandrel and at least one radial contact formed on an inner surface of the housing for transmitting a signal and/or power between the housing and the mandrel, the signal and/or power transmittable before and after the relative movement and the signal and/or power extending between a location in a well above the tools and at least one other below the tool; and couplings on the housing and the tool providing signal and/or power transmitting connections between the tool and the location in the well above the tool and at least one other component below the tool.

13. A downhole tool comprising:

a housing;

a mandrel at least partially disposed within the housing, the mandrel and the housing being relatively movable with respect to each;

a plurality of radially formed contacts on an inner surface of the housing and at least one radial contact formed on an outer surface of the housing for transmitting a signal and/or power between the housing and the mandrel, the signal and/or power transmittable before and after the relative movement and the signal and/or power extending between a location in a well above the tools and at least one other below the tool; and couplings on the housing and the tool providing signal and/or power transmitting connections between the tool and the location in the well above the tool and at least one other component below the tool.

* * * * *

UNITED STATES PATENT AND TRADEMARK OFFICE

CERTIFICATE OF CORRECTION

PATENT NO. : 6,655,460 B2
DATED : December 2, 2003
INVENTOR(S) : Bailey et al.

It is certified that error appears in the above-identified patent and that said Letters Patent is hereby corrected as shown below:

Column 12,
Line 28, please change “housing” to -- mandrel --.

Signed and Sealed this

Twelfth Day of October, 2004

JON W. DUDAS
*Director of the United States Patent and Trademark Office*